US009328593B2

(12) United States Patent
Wright

(10) Patent No.: US 9,328,593 B2
(45) Date of Patent: May 3, 2016

(54) METHOD OF HEATING A HYDROCARBON RESOURCE INCLUDING SLIDABLY POSITIONING AN RF TRANSMISSION LINE AND RELATED APPARATUS

(71) Applicant: HARRIS CORPORATION, Melbourne, FL (US)

(72) Inventor: Brian Wright, Indialantic, FL (US)

(73) Assignee: HARRIS CORPORATION, Melbourne, FL (US)

( * ) Notice: Subject to any disclaimer, the term of this patent is extended or adjusted under 35 U.S.C. 154(b) by 105 days.

(21) Appl. No.: 14/076,501

(22) Filed: Nov. 11, 2013

(65) Prior Publication Data

US 2015/0129202 A1 May 14, 2015

(51) Int. Cl.
*E21B 43/24* (2006.01)

(52) U.S. Cl.
CPC ..... *E21B 43/2401* (2013.01)

(58) Field of Classification Search
CPC ..... E21B 43/2401; E21B 36/04
See application file for complete search history.

(56) References Cited

U.S. PATENT DOCUMENTS

| | | | | |
|---|---|---|---|---|
| 7,441,597 | B2 | 10/2008 | Kasevich | |
| 7,891,421 | B2 * | 2/2011 | Kasevich | E21B 43/003 166/177.1 |
| 2008/0160833 | A1 * | 7/2008 | Shipalesky | E21B 17/026 439/625 |
| 2010/0078163 | A1 | 4/2010 | Banerjee et al. | |
| 2010/0218940 | A1 * | 9/2010 | Parsche | E21B 43/2401 166/248 |
| 2010/0294488 | A1 | 11/2010 | Wheeler et al. | |
| 2010/0294489 | A1 | 11/2010 | Dreher, Jr. et al. | |
| 2011/0264373 | A1 * | 10/2011 | Hehmeyer | E21B 43/16 702/13 |

* cited by examiner

*Primary Examiner* — David Andrews
*Assistant Examiner* — Kristyn Hall
(74) *Attorney, Agent, or Firm* — Allen, Dyer, Doppelt, Milbrath & Gilchrist, P.A.

(57) ABSTRACT

A method for heating hydrocarbon resources in a subterranean formation may include positioning a tubular conductor within a wellbore in the subterranean formation and slidably positioning a radio frequency (RF) transmission line within the tubular conductor so that a distal end of the transmission line is electrically coupled to the tubular conductor. The method may also include supplying RF power, via the RF transmission line, to the tubular conductor so that the tubular conductor serves as an RF antenna to heat the hydrocarbon resources in the subterranean formation.

17 Claims, 7 Drawing Sheets

METHOD OF HEATING A HYDROCARBON RESOURCE INCLUDING SLIDABLY POSITIONING AN RF TRANSMISSION LINE AND RELATED APPARATUS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a largescale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of impedance mismatches between the RF source, transmission line, and/or antenna. These mismatches may become particularly acute with increased heating of the subterranean formation.

SUMMARY OF THE INVENTION

In view of the foregoing background, it is therefore an object of the present invention to provide a hydrocarbon resource heating method and apparatus that provides more efficient hydrocarbon resource heating.

This and other objects, features, and advantages in accordance with the present invention are provided by a method for heating hydrocarbon resources in a subterranean formation that includes positioning a tubular conductor within a wellbore in the subterranean formation, and slidably positioning a radio frequency (RF) transmission line within the tubular conductor so that a distal end of the transmission line is electrically coupled to the tubular conductor. The method also includes supplying RF power, via the RF transmission line, to the tubular conductor so that the tubular conductor serves as an RF antenna to heat the hydrocarbon resources in the subterranean formation.

The method may further include slidably removing the RF transmission line after supplying RF power. The method may further include slidably positioning another RF transmission line within the tubular conductor so that a distal end of the another transmission line is electrically coupled to the tubular conductor, for example. Accordingly, the method may advantageous increase hydrocarbon resource heating efficiency, for example, by permitting removal of the RF transmission line and substitution of another RF transmission line for adjustment of impedance as the formation is heated.

The tubular conductor may carry an electrical receptacle therein, and the RF transmission line may carry an electrical plug at the distal end thereof. Slidably positioning the RF transmission line may include slidably positioning the RF transmission line so that the electrical plug engages the electrical receptacle, for example.

Positioning the tubular conductor may include positioning the tubular conductor with a tubular dielectric section therein so that the tubular conductor defines a dipole antenna, for example. Slidably positioning the RF transmission line may include slidably positioning a coaxial RF transmission line.

The method may further include flowing at least one fluid through the tubular conductor. Flowing the at least one fluid may include flowing the at least one fluid to control at least one of a temperature and pressure. Flowing the at least one fluid may include flowing at least one of a dielectric fluid, a solvent, and a hydrocarbon resource.

An apparatus aspect is directed to an apparatus for heating hydrocarbon resources in a subterranean formation having a wellbore therein. The apparatus includes a tubular conductor positioned within the wellbore. The tubular conductor has an electrical receptacle carried therein. A radio frequency (RF) transmission line has an electrical plug carried at a distal end thereof slidably positioned within the tubular conductor so that the electrical plug engages the electrical receptacle. The apparatus also includes an RF power source configured to supply RF power, via the RF transmission line, to the tubular conductor so that the tubular conductor serves as an RF antenna to heat the hydrocarbon resources in the subterranean formation.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate like elements in different embodiments.

Figure 1:
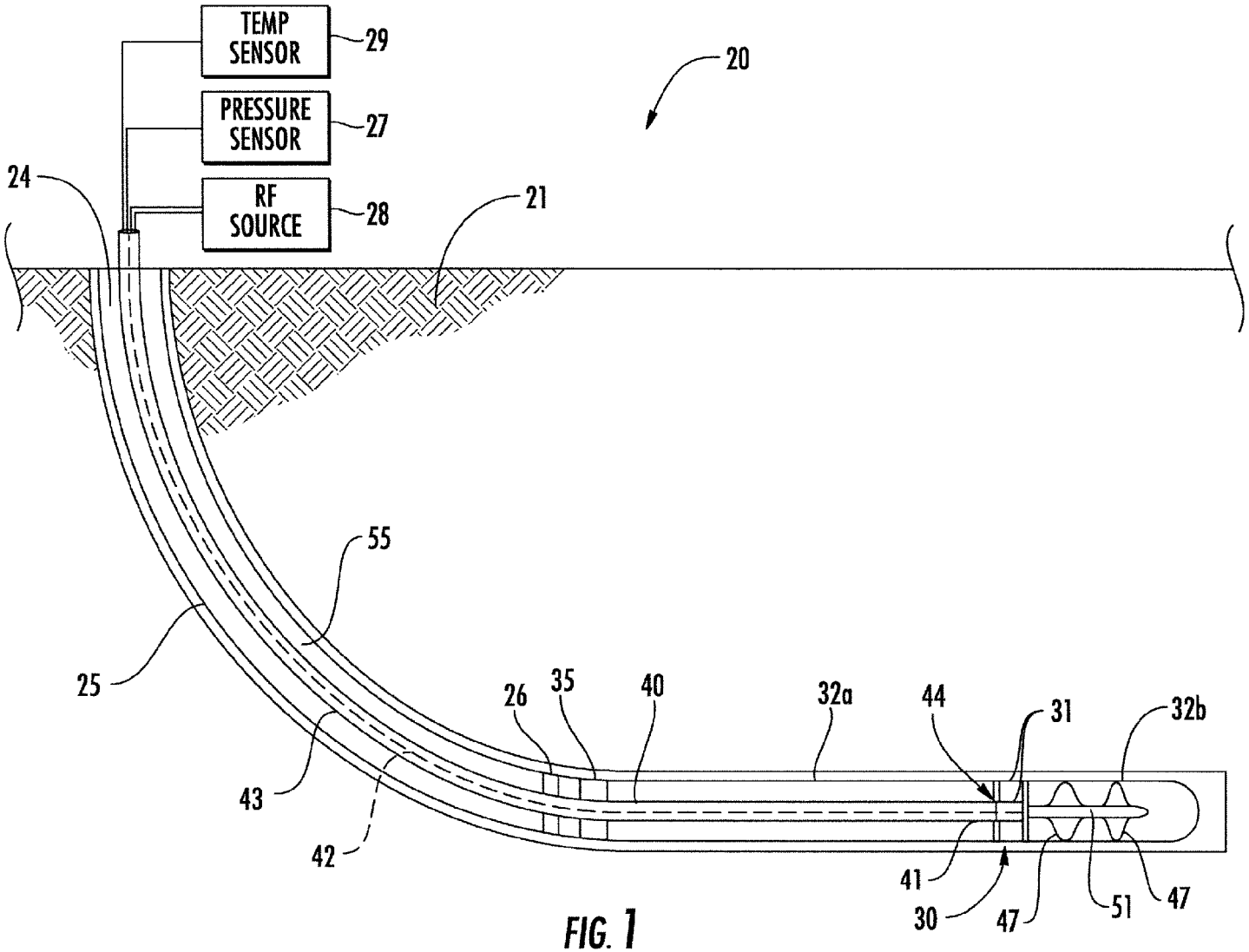
FIG. 1 is a schematic diagram of a subterranean formation including an apparatus in accordance with the present invention.
Figure 2:
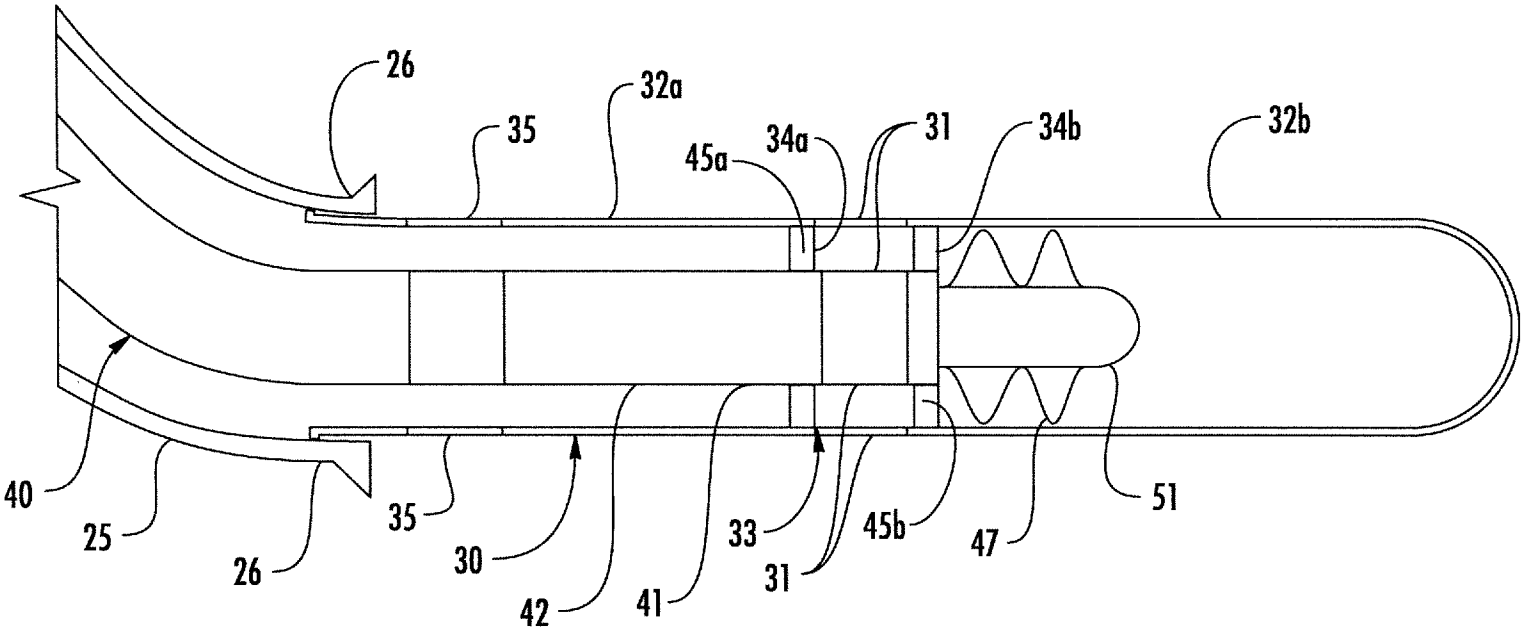
FIG. 2 is an enlarged schematic diagram of a portion of the apparatus of FIG. 1.
Figure 3:
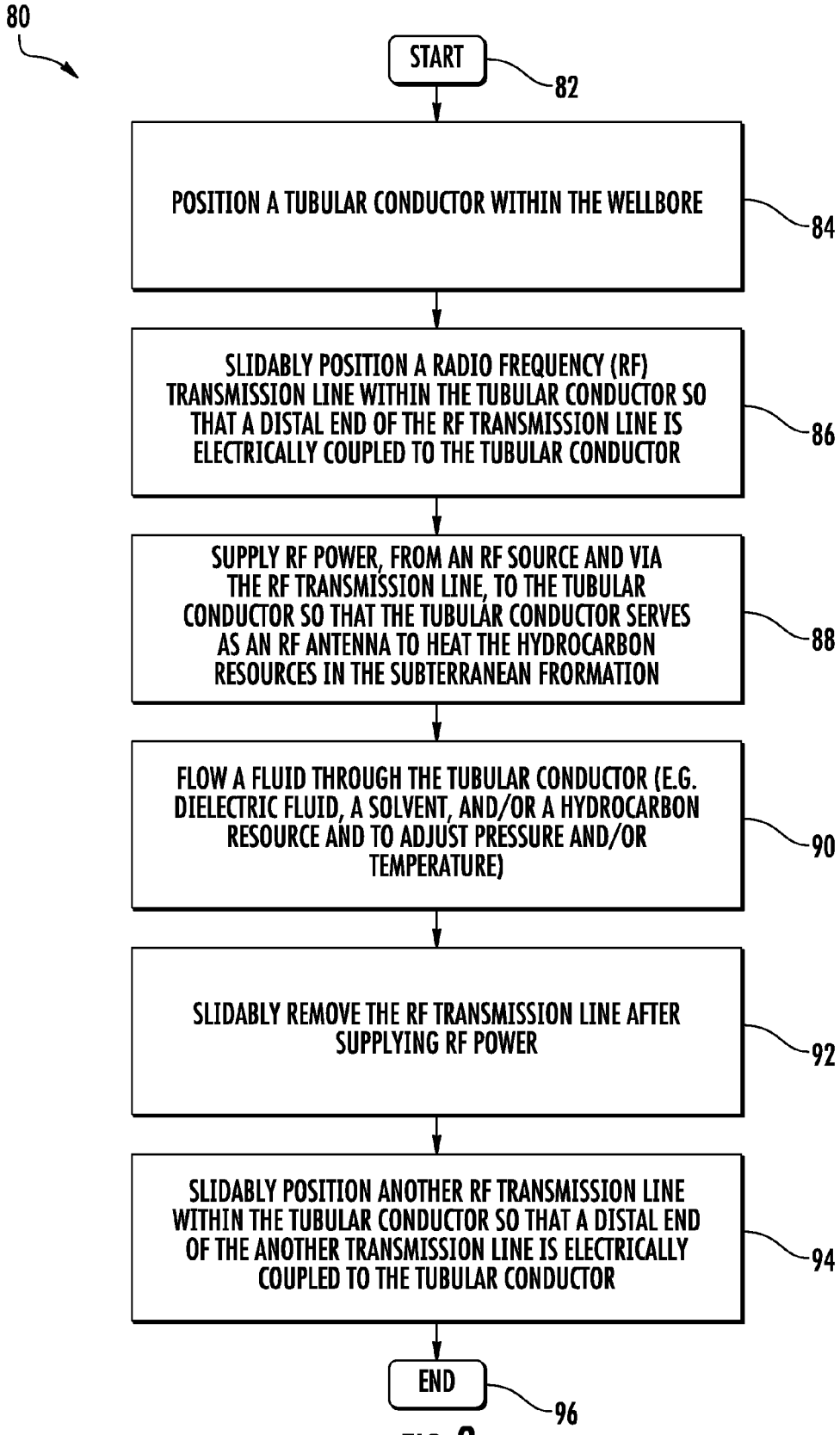
FIG. 3 is a flow chart of a method of heating hydrocarbon resources in accordance with the present invention.

Referring initially to FIGS. 1 and 2, and with respect to the flow chart 80 in FIG. 3, an apparatus 20 and method for heating hydrocarbon resources in a subterranean formation 21 are described. The subterranean formation 21 includes a wellbore 24 therein. The wellbore 24 illustratively extends laterally within the subterranean formation 21. In other embodiments, the wellbore 24 may be a vertically extending wellbore. Although not shown, in some embodiments a respective second or producing horizontal wellbore may be used below the wellbore 24, such as would be found in a SAGD implementation, for the collection of oil, etc., released from the subterranean formation 21 through RF heating.

Figure 4:
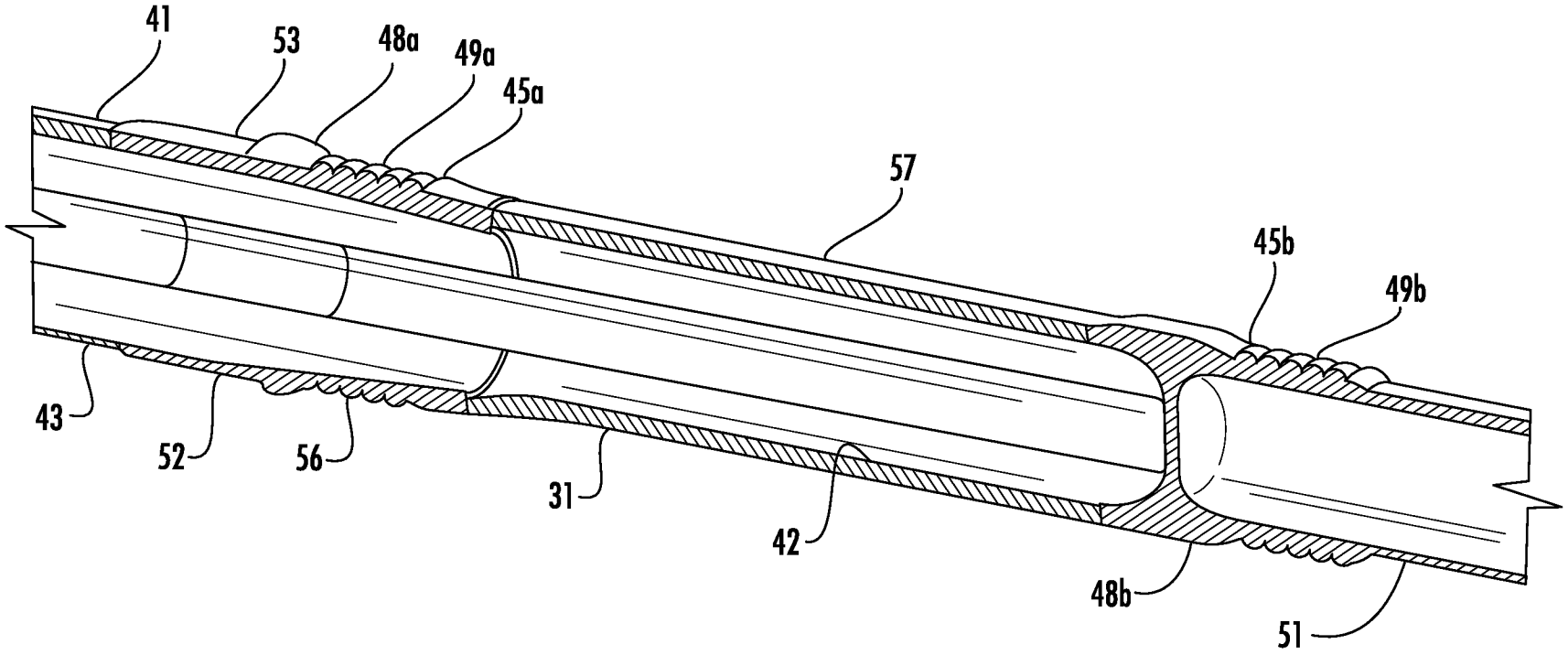
FIG. 4 is a partial cross-sectional view of a portion of the apparatus of FIG. 1.
Figure 5:
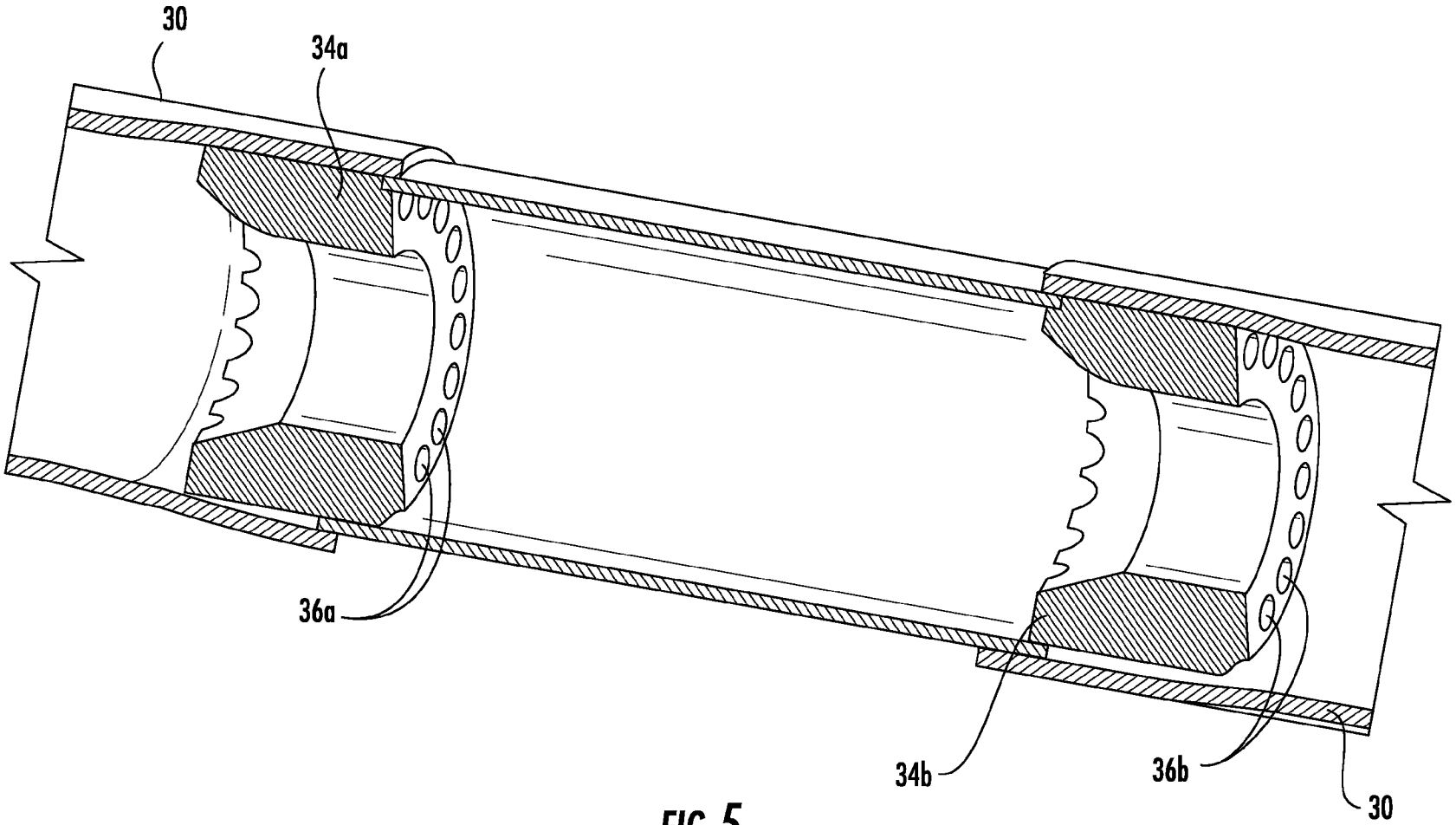
FIG. 5 is another partial cross-sectional view of a portion of the apparatus of FIG. 1.
Figure 6:
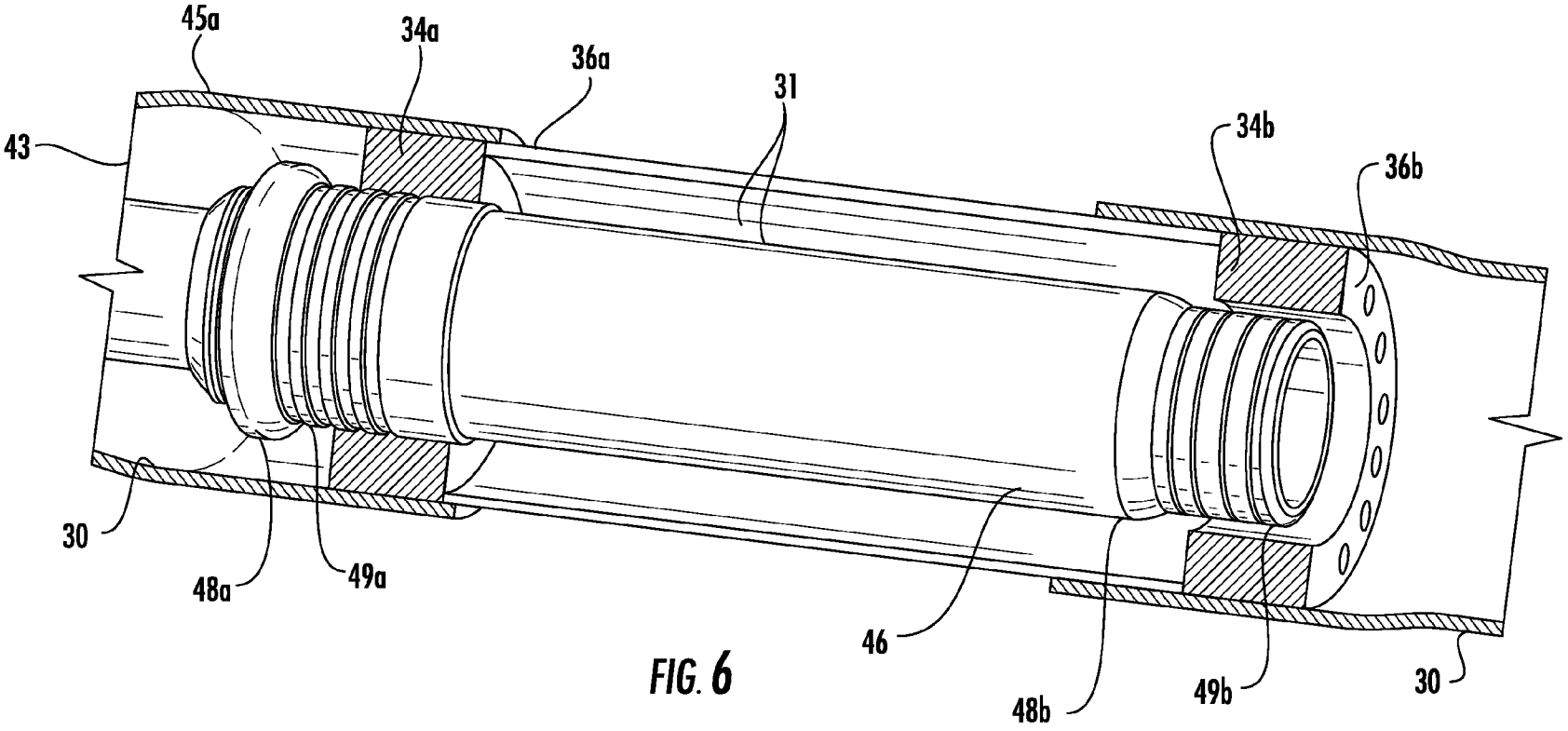
FIG. 6 is yet another partial cross-sectional view of a portion of the apparatus of FIG. 1.

Referring additionally to FIGS. 4-6, beginning at Block 82, the method includes positioning a tubular conductor 30 within the wellbore 24 (Block 84). The tubular conductor 30 may be slidably positioned through an intermediate casing 25, for example, in the subterranean formation 21 extending from the surface. The tubular conductor 30 may couple to the intermediate casing 25 via a thermal liner packer 26 or debris seal packer (DSP), for example. In particular, the intermediate casing 25 may be a TenarisHydril Wedge 563™ 13⅜" J55 casing available from Tenaris S.A. of Luxembourg. The tubular conductor 30 may be a tubular liner, for example, a slotted or flush absolute cartridge system (FACS) liner. In particular, the tubular conductor 30 may be a TenarisHydril Wedge 532™ 10¾" stainless steel liner also available from Tenaris S.A. of Luxembourg. Of course either or both of the intermediate casing 25 and tubular conductor 30 may be another type of casing or conductor.

The tubular conductor 30 has a tubular dielectric section 31 therein so that the tubular conductor defines a dipole antenna. In other words, the tubular dielectric section 31 defines two tubular conductive segments 32*a*, 32*b* each defining a leg of the dipole antenna. Of course, other types of antennas may be defined by different or other arrangements of the tubular conductor 30. The tubular conductor 30 may also have a second dielectric section 35 therein defining a balun isolator. The balun isolator 35 may be adjacent the thermal packer 26. Additional dielectric sections may be used to define additional baluns.

The tubular conductor 30 carries an electrical receptacle 33 therein. More particularly, the electrical receptacle 33 includes first and second electrical receptacle contacts 34*a*, 34*b* that electrically couple, respectively, to the two tubular conductive segments 32*a*, 32*b*. Each of the first and second electrical receptacle contacts 34*a*, 34*b* may have openings 36*a*, 36*b* therein, respectively, to permit the passage of fluids, as will be explained in further detail below.

At Block 86, the method includes slidably positioning a radio frequency (RF) transmission line 40 within the tubular conductor 30 so that a distal end 41 of the RF transmission line is electrically coupled to the tubular conductor. In particular, the RF transmission line 40 is illustratively a coaxial RF transmission line and includes an inner conductor 42 surrounded by an outer conductor 43. An end cap 51 couples to the inner conductor 42 and extends outwardly therefrom. The end cap 51 may be an extension of the second electrical receptacle contact 34*b*. The inner conductor 42 may be spaced apart from the outer conductor 43 by dielectric spacers 52. The dielectric spacers 52 may have openings 53 therein to permit the passage or flow of fluids, as will be explained in further detail below.

The RF transmission line 40 carries an electrical plug 44 at the distal end 41 to engage the electrical receptacle 33. More particularly, the electrical plug 44 includes first and second electrical plug contacts 45*a*, 45*b* electrically coupled to the inner and outer conductors 42, 43. The first and second electrical plug contacts 45*a*, 45*b* engage the first and second electrical receptacle contacts 34*a*, 34*b* of the electrical receptacle 33.

Each electrical plug contact 45*a*, 45*b* may include an electrically conductive body 48*a*, 48*b* and spring contacts 49*a*, 49*b* that may deform when compressed or coupled to the first and second electrical receptacle contacts 34*a*, 34*b*. Of course, other or additional types of electrical plugs 44 and/or coupling techniques may be used. The RF transmission line 40 at the distal end 41 may be spaced from the tubular conductor 30 by dielectric spacers 47, for example, bow spring centralizers.

At Block 88, the method includes supplying RF power, from an RF source 28 and via the RF transmission line 40, to the tubular conductor 30 so that the tubular conductor serves as an RF antenna to heat the hydrocarbon resources in the subterranean formation 21.

The method may include flowing a fluid through the tubular conductor 30 (Block 90). The fluid may include a dielectric fluid, a solvent, and/or a hydrocarbon resource. For example, the tubular conductor 30 and the RF transmission line 40 may be spaced apart to define a fluid passageway 55. A solvent may be flowed through the fluid passageway 55. In some embodiments, the solvent may be dispersed into the subterranean formation 21 through openings in the tubular conductor 30 adjacent the hydrocarbon resources.

In some embodiments, a fluid may be circulated through the RF transmission line 40. For example, the inner conductor 42 may be tubular defining a first fluid passageway 56, and the outer conductor 43 may be spaced apart from the inner conductor to define a second fluid passageway 57. A coolant, for example, may be passed through the first fluid passageway 56 from above the subterranean formation 21 to the RF antenna, and the coolant may be returned via the second fluid passageway 57. Of course, other fluids may be passed through the first and second fluid passageways 56, 57, and the fluid may not be circulated. In other embodiments, the fluid may be passed through other or additional annuli.

Figure 7:
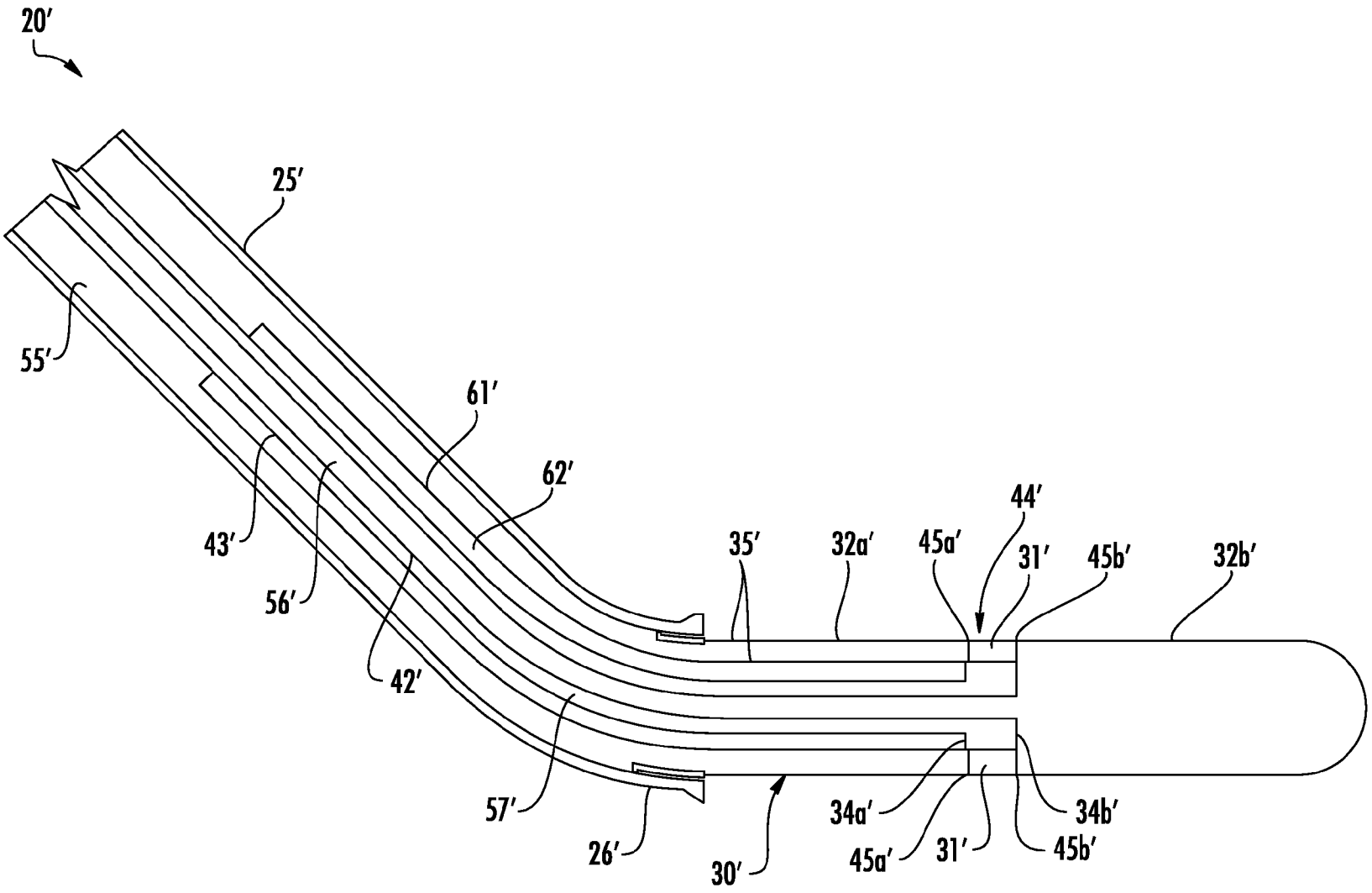
FIG. 7 is an enlarged schematic diagram of a portion of an apparatus in accordance with another embodiment of the present invention.

In other embodiments, for example, as illustrated in FIG. 7, an additional casing 61' or annuli, may surround the RF transmission line 40' and define a balun. The additional casing 61' may define a third fluid passageway 62', for example. In some embodiments, the third fluid passageway 62' may be filled with a balun fluid whose level may be adjusted, for example, to match resonate frequency of the balun to the resonate frequency of the RF antenna. For example, as the subterranean formation 21' changes, the frequency may be adjusted, and thus, also the balun. A pressure check valve may be used to return balun fluid via a fluid passageway designated for fluid return. Additional casings may be used to define additional baluns.

A temperature sensor 29 and/or a pressure sensor 27 may be positioned in the tubular conductor 30, or more particularly, coupled to the RF transmission line 40. The fluid may be flowed (Block 90) to control the temperature and/or pressure. Other or additional sensors may be positioned in the wellbore 24, and the fluid may be flowed to control other parameters.

After supplying RF power to heat the hydrocarbon resources, if, for example, the properties of subterranean formation 21 or RF antenna changed (i.e., impedance), the RF transmission line 40 may be slidably removed (Block 92). Of course, the RF transmission line 40 may be removed for any or other reasons.

If, for example, additional heating of the hydrocarbon resources is desired, the method may include slidably positioning another RF transmission line within the tubular conductor 30 so that a distal end of the another transmission line is electrically coupled to the tubular conductor (Block 94). The method ends at Block 96.

Indeed, the apparatus 20 may advantageously support multiple hydrocarbon resource processes, for example, injection of a gas or solvent while RF power is being supplied, producing or recovering hydrocarbon resources while applying RF power, and using a single wellbore for injection and production. Performing these functions, for example, without an additional wellbore, may provide increased cost savings, thus increasing efficiency.

Moreover, the apparatus 20 allows removal of the RF transmission line 40 from the wellbore 24, and common mode suppression, thus resulting in further cost savings. Also, the RF transmission line impedance may be adjusted during use, which may result in even further cost savings and increased efficiency. For example, at startup (1-2 years) a 50-Ohm RF transmission line may be used. For long term operation (e.g. after 2 years), a 25-30 Ohm RF transmission line may be used.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method for heating hydrocarbon resources in a subterranean formation comprising: positioning a tubular conductor within a wellbore in the subterranean formation; slidably positioning a radio frequency (RF) transmission line comprising an inner conductor surrounded by an outer conductor within the tubular conductor while the tubular conductor is within the wellbore so that a distal end of the transmission line is electrically coupled to the tubular conductor via first and second electrical contacts coupled respectively to the inner and outer conductors; and supplying RF power, via the RF transmission line, to the tubular conductor so that the tubular conductor serves as an RF antenna to heat the hydrocarbon resources in the subterranean formation.

2. The method of claim 1, further comprising slidably removing the RF transmission line after supplying RF power.

3. The method of claim 2, further comprising slidably positioning another RF transmission line within the tubular conductor so that a distal end of the another transmission line is electrically coupled to the tubular conductor.

4. The method of claim 1, wherein the tubular conductor carries an electrical receptacle therein, the RF transmission line carries an electrical plug at the distal end thereof and comprising the first and second electrical contacts; and wherein slidably positioning the RF transmission line comprises slidably positioning the RF transmission line so that the electrical plug engages the electrical receptacle.

5. The method of claim 1, wherein positioning the tubular conductor comprises positioning the tubular conductor with a tubular dielectric section therein so that the tubular conductor defines a dipole antenna.

6. The method of claim 1, further comprising flowing at least one fluid through the tubular conductor.

7. The method of claim 6, wherein flowing the at least one fluid comprises flowing the at least one fluid to control at least one of a temperature and pressure.

8. The method of claim 6, wherein flowing the at least one fluid comprises flowing at least one of a dielectric fluid, a solvent, and a hydrocarbon resource.

9. A method for heating hydrocarbon resources in a subterranean formation having a wellbore therein and having a tubular conductor within the wellbore, the method comprising: slidably positioning a radio frequency (RF) transmission line comprising an inner conductor surrounded by an outer conductor within the tubular conductor while the tubular conductor is within the wellbore so that a distal end of the transmission line is electrically coupled to the tubular conductor via first and second electrical contacts coupled respectively to the inner and outer conductors; and supplying RF power, via the RF transmission line, to the tubular conductor so that the tubular conductor serves as an RF antenna to heat the hydrocarbon resources in the subterranean formation.

10. The method of claim 9, further comprising slidably removing the RF transmission line after supplying RF power.

11. The method of claim 10, further comprising slidably positioning another RF transmission line within the tubular conductor so that a distal end of the another transmission line is electrically coupled to the tubular conductor.

12. The method of claim 9, wherein the tubular conductor carries an electrical receptacle therein, wherein the RF transmission line carries an electrical plug at the distal end thereof and comprising the first and second electrical contacts; and wherein slidably positioning the RF transmission line comprises slidably positioning the RF transmission line so that the electrical plug engages the electrical receptacle.

13. The method of claim 9, further comprising flowing at least one fluid through the tubular conductor.

14. An apparatus for heating hydrocarbon resources in a subterranean formation having a wellbore therein, the apparatus comprising: a tubular conductor positioned within the wellbore and having first and second electrical contacts; a radio frequency (RF) transmission line comprising an inner conductor surrounded by an outer conductor and having third and fourth electrical contacts coupled respectively to said inner and outer conductors and carried at a distal end thereof slidably positioned within said tubular conductor so that said first and second electrical contacts engage said third and fourth electrical contacts; and an RF power source configured to supply RF power, via said RF transmission line, to said tubular conductor so that said tubular conductor serves as an RF antenna to heat the hydrocarbon resources in the subterranean formation.

15. The apparatus of claim 14, wherein said tubular conductor has a tubular dielectric section therein defining a dipole antenna.

16. The apparatus of claim 14, wherein said tubular conductor defines a fluid passageway.

17. The apparatus of claim 14, further comprising at least one of a temperature sensor and a pressure sensor associated with said tubular conductor.

* * * * *